US007737898B2

(12) United States Patent
Hanusa et al.

(10) Patent No.: US 7,737,898 B2
(45) Date of Patent: Jun. 15, 2010

(54) VERY HIGH FREQUENCY LINE OF SIGHT WINGLET ANTENNA

(75) Inventors: John H. Hanusa, Celeste, TX (US); Claude W. Tignor, III, Greenville, TX (US); Vincent A. May, Wylie, TX (US); Wesley D. Redus, Greenville, TX (US); SueAnn Stuart, Greenville, TX (US); Paul W. Hein, McKinney, TX (US)

(73) Assignee: L-3 Communications Integrated Systems, L.P., Greenville, TX (US)

( * ) Notice: Subject to any disclaimer, the term of this patent is extended or adjusted under 35 U.S.C. 154(b) by 124 days.

(21) Appl. No.: 11/712,694

(22) Filed: Mar. 1, 2007

(65) Prior Publication Data

US 2008/0210822 A1 Sep. 4, 2008

(51) Int. Cl.
*H01Q 1/28* (2006.01)

(52) U.S. Cl. ..... 343/708; 343/705

(58) Field of Classification Search ..... 343/705, 343/708, 767
See application file for complete search history.

(56) References Cited

U.S. PATENT DOCUMENTS

| | | | | |
|---|---|---|---|---|
| 2,505,751 | A * | 5/1950 | Bolljahn | 343/708 |
| 2,700,104 | A * | 1/1955 | Bowman | 343/853 |
| 3,725,941 | A * | 4/1973 | Stang | 343/708 |
| 3,771,157 | A * | 11/1973 | Stang | 343/708 |
| 3,774,220 | A | 11/1973 | Martin et al. | 343/708 |
| 3,977,004 | A | 8/1976 | Bickel | 343/705 |
| 5,900,843 | A | 5/1999 | Lee | 343/767 |
| 6,496,151 | B1 | 12/2002 | Ferreri et al. | 343/708 |
| 6,653,980 | B2 * | 11/2003 | Ceccom et al. | 343/705 |
| 6,714,163 | B2 | 3/2004 | Navarro et al. | 343/705 |
| 6,954,182 | B2 * | 10/2005 | Knapp | 343/705 |
| 6,982,677 | B2 * | 1/2006 | Kennedy et al. | 343/767 |
| 7,019,705 | B2 | 3/2006 | Pfletschinger et al. | 343/770 |
| 7,182,297 | B2 * | 2/2007 | Jackson | 244/231 |

(Continued)

FOREIGN PATENT DOCUMENTS

WO 2004/066433 A2 8/2004

OTHER PUBLICATIONS

PCT/US2008/002245, "*International Search Report*," filed Feb. 20, 2008.

*Primary Examiner*—Michael R Mansen
*Assistant Examiner*—Brian M O'Hara
(74) *Attorney, Agent, or Firm*—O'Keefe, Egan, Peterman & Enders, LLP

(57) ABSTRACT

A line of sight antenna supported in an upturned terminal winglet or similar vertical member of an aircraft is disclosed. An aperture is formed in the conductive winglet or vertical member, and the antenna is supported within the aperture by a support mechanism such that the antenna is exposed to the line of sight transmissions. A non-conductive covering may also be used for the aperture. Using the cover, the antenna within the winglet can be configured so that it does not alter the appearance or aerodynamic characteristics of the aircraft. Alternatively, the antenna can be coupled to the outside of the winglet or vertical member if cosmetics are not a concern. The frequency range of the antenna can be tuned to cover desired frequency ranges. The antenna position at the winglet maintains a large physical separation from fuselage-mounted antennas thereby reducing interference.

23 Claims, 3 Drawing Sheets

U.S. PATENT DOCUMENTS 7,274,336 B2 9/2007 Carson ..... 343/705
7,511,674 B2 * 3/2009 McNutt ..... 343/705
2002/0186170 A1 * 12/2002 Ceccom et al. ..... 343/705
2008/0169987 A1 * 7/2008 McNutt ..... 343/705

* cited by examiner

VERY HIGH FREQUENCY LINE OF SIGHT WINGLET ANTENNA

GOVERNMENT RIGHTS

This invention was made with United States Government support under Contract No. G07902DACE. The Government has certain rights in this invention.

TECHNICAL FIELD OF THE INVENTION

This invention relates to a very high frequency line of sight antennas supported in an aircraft wing with an upturned terminal winglet or similar vertical member, and particularly to a winglet antenna supported in a cutaway aperture in a conductive winglet having a non-conductive covering for the aperture.

BACKGROUND

Certain antennas installed within aircraft exist in the prior art. However, current art aircraft antennas have a co-location interference problem with other radios and their antennas that occur, mainly due to their location in the aircraft fuselage. When antennas are added to an aircraft fuselage an extensive coupling analysis is required, and subsequent relocation of several existing antennas usually has to occur. Further, the addition of current art antennas can alter the cosmetic appearance of the aircraft, or can alter or degrade the aerodynamic characteristics of the aircraft. Other attempts to add a line of sight antenna involve installation of monopole antennas to the aircraft fuselage. As the number of antennas increases, reduced spacing with consequential reduction of electrical isolation must be accepted. One current state of art High Frequency (HF) antenna installed in a right winglet of a GIII aircraft has a ⅝ inch diameter curved tube, but is not appropriate to service a Very High Frequency (VHF) radio.

SUMMARY OF THE INVENTION

The methods and systems described herein provide a line of sight antenna supported in an aircraft wing with an upturned winglet or similar vertical member. As described below, the winglet antenna can be implemented using a cutaway aperture in a conductive winglet, a support structure configured to support the antenna in the aperture such that the antenna remains exposed to the line of sight transmissions, and a non-conductive covering for the aperture. In more detailed aspects, the antenna, as installed, does not substantially alter the appearance or aerodynamic characteristics of the aircraft. In another embodiment, the winglet antenna may be coupled to the outside of the non-conductive covering for the aperture. In addition, other features and variations could be implemented, if desired, and related methods can be utilized, as well.

In a further embodiment, a method is disclosed for receiving signals with a line of sight antenna, including the steps of supporting the antenna in a cutaway aperture in an upturned winglet or similar vertical member of an aircraft wing such that the antenna is exposed to line of sight transmissions. In addition, the aperture can be covered with a non-conductive material, if desired. In addition, other features and variations can be implemented, if desired, and related systems can be utilized, as well.

As described further herein, the frequency range of the winglet antenna can be adapted to cover desired frequency ranges. For example, the winglet antenna can be configured for a range of frequencies from very high frequency (VHF) frequencies, to ultra high frequency (UHF) frequencies and beyond. The techniques described herein, for example, can be used for a line of site winglet antenna covering the aircraft very high frequency (VHF) radio spectrum from 118 to 152 MHz.

DESCRIPTION OF THE DRAWINGS

It is noted that the appended drawings illustrate only exemplary embodiments of the invention and are, therefore, not to be considered limiting of its scope, for the invention may admit to other equally effective embodiments.

DETAILED DESCRIPTION OF THE INVENTION

The systems and methods described herein provide a line of sight antenna supported by an aircraft wing with an upturned winglet or similar vertical member. In one implementation, an antenna is supported within a cutaway aperture in a conductive winglet or similar vertical member of an aircraft wing such that the antenna remains exposed to the line of sight transmissions. In addition, a non-conductive covering for the aperture can be used to improve the aerodynamic performance and/or cosmetic look of the aircraft wing. Further, the antenna could be coupled to the outside of the non-conductive covering if desired. The line of site winglet antenna will now be more fully described with respect to the drawings.

Figure 1:
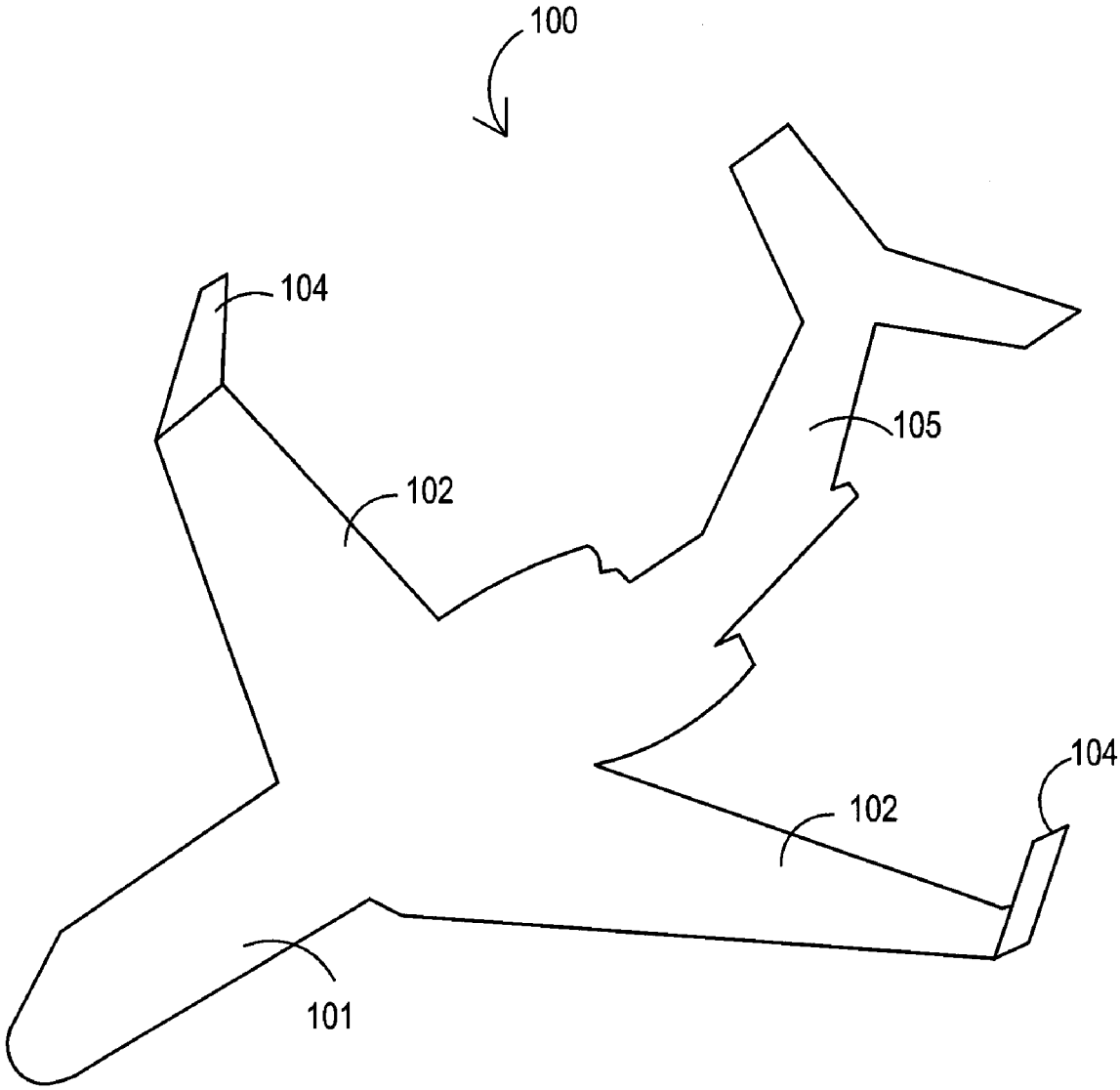
FIG. 1 is a diagram of an aircraft having a wing with an upturned terminal winglet and/or similar vertical member with respect to which the winglet antenna can be positioned.

FIG. 1 shows an aircraft embodiment 100 including an aircraft having a wing with an upturned terminal winglets at the ends of the aircraft wings. As depicted, the aircraft 101 has wings 102 with upturned winglets 104 that can be used to support a high frequency line of sight antenna. In addition to the winglets 104, the aircraft 101 also has other similar vertical members, such as vertical member 105, that can be used to support a very high, frequency line of sight antenna. In one support structure implementation, a cutaway aperture is configured in the conductive winglet 104 or similar vertical member 105. Support structures are then included within the aperture to support the antenna such that the antenna remains exposed to line of sight transmissions. In addition, the aperture can be covered by a non-conductive covering, if desired.

In operation, the antenna position within the winglet 104 or similar vertical member 105 advantageously maintains a large physical separation between the antenna and fuselage-mounted antennas. For aircraft having multiple communications systems, this degree of physical separation provides an advantage by reducing antenna-to-antenna coupling, which in turn reduces the potential of interference between radio systems operating in similar or adjacent frequencies.

It is noted the techniques described herein primarily relate to mounting the antenna element in a cutaway aperture in a conductive winglet or similar vertical member. In addition, it is described that a non-conductive covering can be used to cover the aperture such that the physical appearance of the winglet is not substantially altered and the aerodynamics of the wing are not substantially altered. However, it is understood that in cases where the cosmetics of a hidden antenna are unimportant, alternate configurations can include securing the antenna element to the outside of the wing, such as to a fiberglass radome or leading edge of the wing. In this embodiment, a strip of the original metal leading edge (e.g., a 1 to 1.5 inch strip) can be notched out and the notch filled in with fiberglass so that the remainder of the leading edge forms a shunt radiating element electrically isolated from the surrounding structure at all points but one similar in geometry to the embedded element.

It is further noted that the systems and methods described herein can be used for an extended range VHF antenna installed on a aircraft, such as Gulfstream (e.g., GIII, GIV and GV aircraft), with a peak Voltage Standing Wave Ratio (VSWR) in the range of 3:1. It is understood that since some radios, ARC-210s and some other ATC and Tactical Military radios, for example, are more sensitive to high VSWR, this sensitivity can be alleviated by installing a high power 1 dB to 2 dB attenuator in the feed-line between the radio and the antenna reducing VSWR as seen by the radio to 2:1 and below. This alternative technique could also be used to suppress intermodulation products from inline filters and spurious effects from lightning arrestors.

Figure 2:
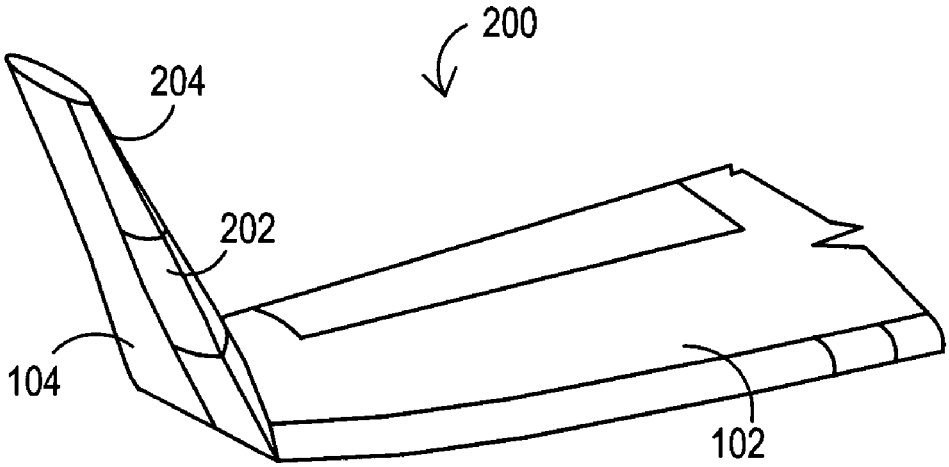
FIG. 2 is a diagram of an aircraft wing having a winglet antenna installed therein.

FIG. 2 shows an example embodiment 200 including an aircraft wing with a winglet antenna installed therein. The wing 102 has an upturned winglet 104 with an upturned wing leading edge 204. It is understood that a winglet antenna 202 can be installed in a winglet 104 or similar vertical member, although the description herein is primarily directed to a winglet and, more particularly, to a winglet 104 made of conductive material. In the embodiment depicted, the winglet antenna 202 is installed in a cutaway aperture in a conductive winglet 104 and is supported by structural support within the aperture such that the antenna 202 remains exposed to line of sight transmissions. In addition, a non-conductive covering for the aperture can be utilized. In this way, the winglet antenna 202 is mounted by physically embedding it within an aperture within the leading edge of one of the winglets 104 on the aircraft. The winglet antenna visual appearance can be such that there is no substantial cosmetic impact. For example, a casual observer would not perceive that an antenna 202 is contained within the winglet 104. The winglet antenna 202 can also be installed without substantially altering or degrading aerodynamic characteristics of the aircraft.

Figure 3:
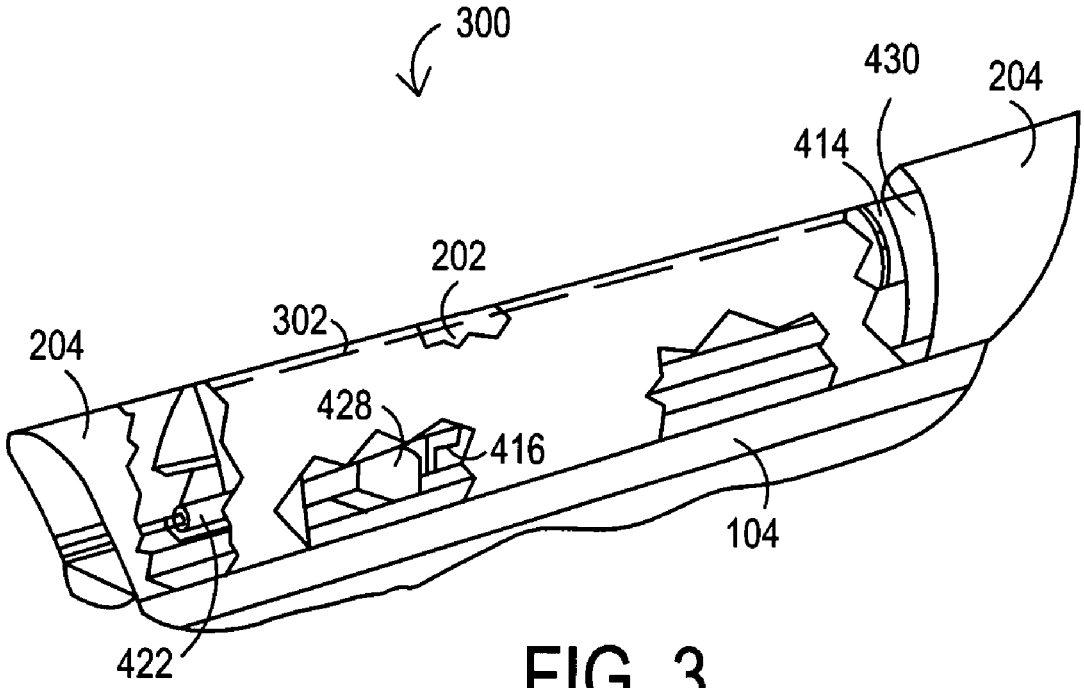
FIG. 3 is a diagram of a winglet antenna installed in a leading edge.

FIG. 3 shows an example embodiment 300 in which a winglet antenna installed in a cavity or aperture within the leading edge of an aircraft wing. In particular, a non-conductive dielectric cover 302 is placed over the aperture in the metallic leading edge 204 and attached to it by fasteners in splice plate 430. The aperture forms a conductive structure within the winglet 104 into which a shunt radiating element or other antenna element 202 of the winglet antenna is placed. The winglet tip end of the antenna element 202 is electrically connected to the adjacent skin and structure of the conductive winglet through the splice plate 430, for example, using dual ground straps 414 while all of the other surfaces of the antenna are isolated from the conductive winglet. The ground strap 414 can be a piece of thin sheet metal that is attached by a fastener to the antenna element 202, or the ground strap 414 can be any other desired metallic structure installation that couples at a first end to the antenna element 202 and couples at a second end to the aircraft structure in order to provide an electrical grounding path.

In operation, the winglet antenna element 202 exhibits high efficiency as a radiator and receiver of radio frequency (RF) signals. Frequency range of the antenna element 202 can be adapted through extension of the design described herein to cover any desired frequency range. In particular, the winglet antenna described herein is useful for frequency ranges from very high frequency (VHF) frequencies through ultra high frequency (UHF) frequencies and beyond, from about 3 MHz to 1000 MHz and beyond. One particular set of dimensions described herein are for an antenna element 202 covering an aircraft very high frequency (VHF) radio spectrum from 118 to 152 MHz. However, by changing the length of the antenna element 202 within the winglet and considering winglet space constraints, other frequency ranges that can efficiently be covered include from HF to at least the lower part of the ultra high frequency (UHF) band, for example, from about 30 to about 1000 MHz.

It is also noted that the VHF band typically refers to frequencies within a range between about 30 MHz and about 300 MHz. And the UHF band typically refers to frequencies within a range between about 300 MHz and about 3000 MHz. More generally, it is noted that the cutaway aperture is cut away for a vertical length corresponding to a size needed to house an antenna configured for a desired frequency range. The antenna is then sized according to the desired frequency range of reception and coupled within the aperture. This frequency range of reception, therefore, can be any desired range of frequencies to be received by the antenna, and the aperture and the antenna can be sized accordingly.

Figure 4A:
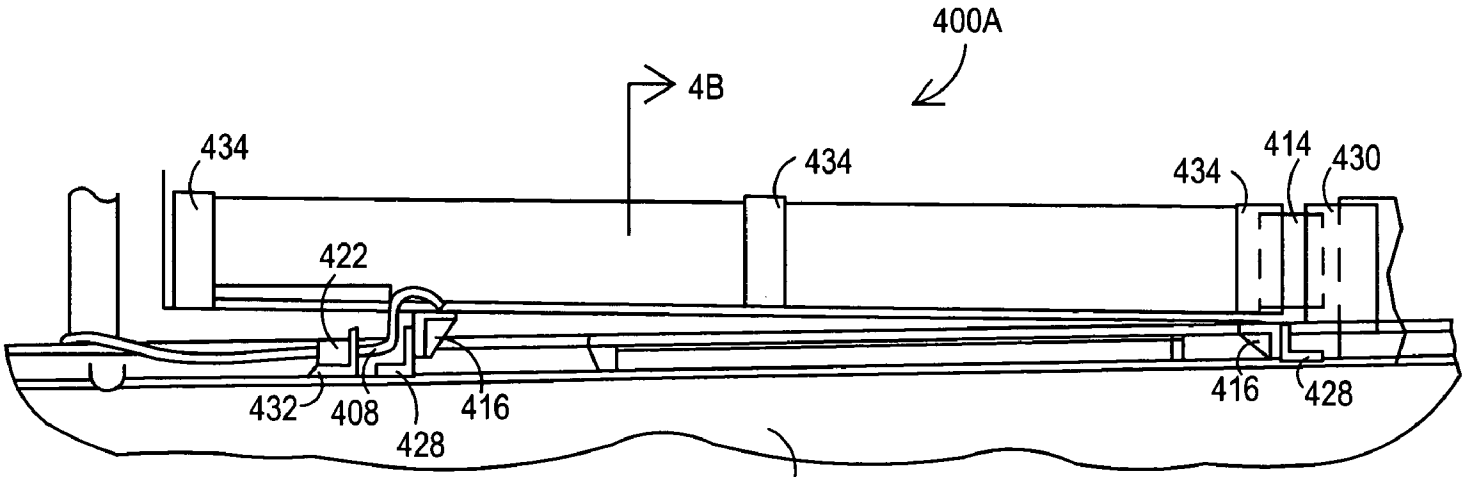
FIG. 4A is a diagram of a winglet antenna assembly.

FIG. 4A shows a winglet antenna assembly 400A. As depicted in this embodiment, the high frequency line of sight antenna 202 includes a formed sheet metal element mounted parallel to the winglet leading edge near the winglet 104. The winglet tip end of the antenna element 202 is electrically connected to the adjacent skin and structure with dual ground straps 414 through the splice plate 430 while all of the other surfaces are isolated from it. The antenna element 202 is connected to the radio system on board the aircraft through a coaxial connector 422 and coaxial feed-line 408 or harness assembly by a wire attached to the element approximately seven inches from its free end. An antenna 202 can be installed, for example, on Gulfstream aircraft which are typically configured to communicate using VHF AM transceiver with a tuning range of 118 to 152 MHz.

As described herein, the line of sight antenna is supported in an upturned terminal winglet of an aircraft wing or in a similar vertical member of the aircraft. A cutaway aperture is provided in the conductive winglet and a support structure within the aperture supports the antenna such that the antenna remains exposed to line of sight transmissions. A non-conductive covering for the aperture can also be provided. For example, for 118 to 152 MHz operation, the length of the cutaway can be approximately 30 inches, and the cutaway can be approximately 6 inches deep. Reinforcement of the winglet 104 for structural integrity can also be made according to standard airborne structural and airworthiness design criteria as needed depending upon the size of the aperture. As described above, the length of the antenna element 202 can be changed in order to facilitate the reception of other frequency ranges, as desired, including at least the lower part of ultra high frequency (UHF) band, for example, up to about 1000 MHz. Limitations on the size of the aperture, the size of the antenna, and the frequency ranges are based upon considerations of the aerodynamics of the aircraft winglet utilized and/or a similar vertical member of the aircraft utilized to house the aperture and the antenna.

Figure 4B:
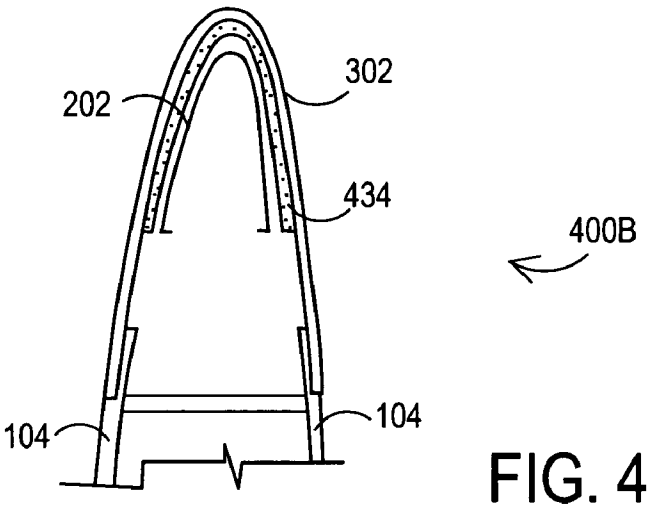
FIG. 4B is a cross section of a winglet antenna assembly.

FIG. 4B shows a cross section for an example embodiment 400B of the leading edge of a winglet having an antenna element mounted therein. Once the cutaway is made in the leading edge, the leading edge of the winglet 104 can then be restored to its original contour by fabricating and affixing a non-conductive dielectric cover 302 to cover the cavity in the leading edge conductive structure of the winglet. The non-conductive cover 302 may be fabricated, for example, using fiberglass composite material. A shunt radiating element or antenna element 202 of the winglet antenna can then be supported within the aperture. Abrasion at the antenna element is prevented by spacer tape 434

In one embodiment 400B depicted, the antenna element 202 is a shunt radiating element. This shunt radiating element, for example, can include a rigid sheet of conductive material formed to fit within the inside of the non-conductive dielectric cover 302. This shunt radiating element provides a large cross sectional area and maintains a fixed separation from the floor of the winglet cutaway. For 118 to 152 MHz operation, the shunt radiating element can be configured to have a length of 29 inches and a width before forming of approximately 7 inches. To form the shunt radiating element to the shape of the winglet cover or leading edge, the sheet is rolled into a shape having a smoothly curved leading edge and a trailing edge consisting of a pair of flat surfaces turned inward at either side. The top end of the shunt radiating element is then attached and electrically bonded to the winglet conductive material at the top end of the cutaway. The electrical bonding from the shunt radiating element is configured to be of a large surface area in order to maintain a low-inductance path for the element-to-winglet radio frequency path.

Looking back now to FIG. 4A, it is seen that the shunt radiating element/antenna element 202 is supported at a fixed separation from the floor of the cutaway by non-conductive dielectric brackets 416 in order to prevent conductive paths and to minimize capacitances between the shunt radiating element/antenna element 202 and the floor of the cutaway. The bottom end of the shunt radiating element/antenna element 202 can be fixed approximately 3 inches from the bottom of the winglet cutaway, supported by a dielectric bracket 416. The dielectric brackets 416 are attached to the winglet structure 104 by metal brackets 428. At the bottom end of the shunt radiating element/antenna element 202, a coaxial connector 422 is affixed to the floor of the cutaway in the bracket 432. The ground of the coaxial connector 422 is strapped and electrically bonded to the floor of the cutaway in the winglet by a bracket 432. The ground strap 414 can be a piece of thin sheet metal that is attached by a fastener on the antenna element 202, or it can be another metallic structure installation that is attached at a first end to antenna element and at a second end to the aircraft structure in order to provide an electrical grounding path. The electrical bonding from the ground of the coaxial connector 422 cab be configured to be a large surface area to maintain a low-inductance path for the coaxial cable-to-winglet cutaway floor radio frequency path.

In further respects, a conductive wire can be attached at the center conductor terminal of the coaxial connector 422. This wire can be 10 to 12 gauge copper wire having a highly conductive anti-corrosive coating that excludes nickel or other ferromagnetic components. This wire is routed in a straight path to its termination with an electrical connection to the trailing surface of the shunt radiating element/antenna element 202, for example, at a distance of roughly 6 inches (150 mm) from the lower end of the shunt radiating element/antenna element 202. This wire is routed to keep it from touching conductive surfaces in the length from the coaxial connector 422 to its attachment to the shunt radiating element/antenna element 202. Adjustment of the impedance characteristics of the winglet antenna can be made by varying the height of the wire attachment to the shunt radiating element/antenna element 202. Additional components can be added to the winglet antenna for lightning protection and impedance matching as deemed necessary.

It is noted that the embodiments disclosed herein can be adjusted and/or modified as desired depending upon the operational conditions and physical environment for the winglet antenna. In addition, the dimensions indicated above are provided for example purposes and should not be deemed as necessary for all implementations. Other configurations are also possible that do not couple the antenna within the aperture. For example, as indicated above, the antenna could be coupled to the outside of the leading edge where cosmetic changes to the aircraft are not a concern. It is further noted that a winglet or vertical portion of an aircraft may not be exactly perpendicular to the plane of the wing (considering the winglet) or the aircraft (consider another vertical member). As contemplated herein, an upturned winglet or vertical member could include any portion of the aircraft or aircraft wing that extends generally in a plane that is 15 to 90 degrees from a general horizontal plane of the aircraft wing and/or the aircraft fuselage, respectively.

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein, and certain features of the invention may be utilized independently of the use of other features, all as would be apparent to one skilled in the art after having the benefit of this description of the invention.

What is claimed is:

1. A line of sight antenna supported in a vertical portion of an aircraft, comprising:

an aperture in an upturned terminal winglet of an aircraft wing or similar vertical member of an aircraft, the winglet or member being conductive;

a supporting mechanism configured to support an antenna in the aperture;

an antenna supported by the supporting mechanism and configured to remain exposed to line of sight transmissions, the antenna comprising;

a shunt radiating element formed to fit within the aperture, the shunt radiating element comprising a sheet of conductive material configured to have a curved leading edge and a trailing edge including a pair of flat surfaces; and a ground strap having a first end affixed to a first end of the shunt radiating element and a second end affixed to an aircraft structure, the ground strap being configured to provide an electrical grounding path from the shunt radiating element to the aircraft structure;

a coaxial connector having a ground and a feed-line, the feed-line for the coaxial connector being configured to electrically connect a second end of the shunt radiating element to an aircraft system, and the ground for the coaxial connector being electrically connected to the aircraft structure; and a non-conductive covering for the aperture.

2. The antenna of claim 1, wherein the antenna is mounted by physically embedding it within the aperture in a leading edge of the winglet or vertical member.

3. The antenna of claim 2, wherein the leading edge is substantially unaltered cosmetically by the mounting of the antenna within the terminal winglet or vertical member.

4. The antenna of claim 2, wherein the aircraft wing is substantially unaltered aerodynamically by the mounting of the antenna within the terminal winglet or vertical member.

5. The antenna of claim 2, wherein the aperture is cut away for vertical length corresponding to a desired frequency range of reception for the antenna.

6. The antenna of claim 5, further comprising a non-conductive dielectric radome configured to create a cavity in the conductive terminal winglet or vertical member.

7. The antenna of claim 1, wherein the aperture is configured to have a length along an edge of the terminal winglet or vertical member that is greater than a depth into the edge of the terminal winglet or vertical member.

8. The antenna of claim 1, wherein the shunt radiating element is supported at a fixed separation from a floor of the aperture by non-conductive dielectric brackets.

9. The antenna of claim 8, wherein the coaxial connector is affixed to a floor of the aperture by a bracket at a bottom end of the shunt radiating element.

10. The antenna of claim 1, wherein frequency range of the antenna is configured to cover a frequency range within from about 30 MHz to about 3000 MHz.

11. The antenna of claim 10, wherein the frequency range of the antenna covers a frequency range from about 118 MHz to about 152 MHz.

12. The antenna of claim 1, wherein the antenna is mounted to an outside surface of the winglet or vertical member.

13. An aircraft having a wing antenna, comprising:

an aperture in a conductive upturned terminal winglet or vertical member of an aircraft;

a supporting mechanism for an antenna configured within the aperture;

a line of sight antenna supported within the upturned terminal winglet or vertical member by the supporting mechanism, the antenna configured to remain exposed to line of sight transmissions, the antenna comprising;

a shunt radiating element formed to fit within the aperture, the shunt radiating element comprising a sheet of conductive material configured to have a curved leading edge and a trailing edge including a pair of flat surfaces; and a ground strap having a first end affixed to a first end of the shunt radiating element and a second end affixed to an aircraft structure, the ground strap being configured to provide an electrical grounding path from the shunt radiating element to the aircraft structure;

a coaxial connector having a ground and a feed-line, the feed-line for the coaxial cable being configured to electrically connect the a second end of the shunt radiating element to an aircraft system, and the ground for the coaxial connector being electrically connected to the aircraft structure; and a non-conductive covering for the aperture.

14. The aircraft of claim 13, wherein the antenna is mounted by physically embedding it within an aperture in a leading edge of the terminal winglet or vertical member.

15. The antenna of claim 14, wherein the aircraft wing is substantially unaltered cosmetically by the mounting of the antenna within the terminal winglet or vertical member.

16. The antenna of claim 14, wherein the aircraft wing is substantially unaltered aerodynamically by the mounting of the antenna within the terminal winglet or vertical member.

17. The aircraft wing of claim 16, wherein the frequency range of the antenna covers a frequency range from about 118 MHz to about 152 MHz.

18. The aircraft wing of claim 13, wherein the antenna is mounted to an outside surface of the winglet or vertical member.

19. A method of receiving line of sight signals with an aircraft wing antenna, comprising: providing a shunt radiating element for an antenna formed to fit within an aperture, the shunt radiating element comprising a sheet of conductive material configured to have a curved leading edge and a trailing edge including a pair of flat surfaces; supporting the shunt radiating element within an aperture of an upturned terminal winglet or vertical member of an aircraft, the terminal winglet or vertical member being conductive; connecting a ground strap between a first end of the shunt radiating element and an aircraft structure, the ground strap being configured to provide an electrical grounding path from the shunt radiating element to the aircraft structure; connecting a feed-line for a coaxial connector to a second end of the shunt radiating element; receiving line of sight transmissions with the antenna through a non-conductive covering; and coupling signals received by the antenna to an aircraft system using the feed-line for the coaxial connector, the coaxial connector further having a ground electrically connected to the aircraft structure.

20. The method of claim 19, further comprising mounting the antenna by physically embedding it within an aperture in a leading edge of the terminal winglet or vertical member.

21. The method of claim 19, wherein frequency range of the antenna can be adapted to cover frequency ranges within from about 30 MHz to about 3000 MHz.

22. The method of claim 19, wherein frequency range of the antenna covers a very high frequency (VHF) radio spectrum from 118 to 152 MHz.

23. The method of claim 19, further comprising mounting the antenna to an outside surface of the winglet or vertical member.

* * * * *